United States Patent [19]

Killinger

[11] Patent Number: 4,497,268

[45] Date of Patent: Feb. 5, 1985

[54] TOP WORK FEEDING ARRANGEMENT FOR A CHAIN STITCH SEWING MACHINE

[75] Inventor: Karl H. Killinger, Dover, N.J.

[73] Assignee: The Singer Company, Stamford, Conn.

[21] Appl. No.: 600,704

[22] Filed: Apr. 16, 1984

[51] Int. Cl.[3] ..... D05B 27/04; D05B 1/06; D05B 97/02

[52] U.S. Cl. ..... 112/169; 112/320

[58] Field of Search ..... 112/320, 197, 199, 169, 112/11

[56] References Cited

U.S. PATENT DOCUMENTS 1,809,192 6/1931 Cahill et al. .
3,837,306 9/1974 Doyel .
4,411,210 10/1983 Killinger ..... 112/169 X
4,463,695 8/1984 Killinger ..... 112/169
4,474,123 10/1984 Ponte ..... 112/169 X

FOREIGN PATENT DOCUMENTS 5712997 7/1979 Japan .
57-48872 3/1982 Japan .

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A hand operable chain stitch sewing machine is provided with a top work feeding arrangement wherein a feed dog is mounted for pivotal movement about mutually perpendicular axes. The feed dog is moved about one such axis to engage a workpiece, and about the other axis to displace a work piece relative to a sewing needle.

6 Claims, 4 Drawing Figures

TOP WORK FEEDING ARRANGEMENT FOR A CHAIN STITCH SEWING MACHINE

BACKGROUND OF THE INVENTION

1. Field of the Invention:

The invention relates to chain stitch sewing machines and more particularly to work feeding arrangements therefor.

2. Description of the Prior Art:

Single thread chain stitch sewing machines with double pointed loopers and with feeding mechanism for moving work back and forth under a sewing needle are commonly used for sewing buttons onto garments and for sewing superimposed tacking stitches. Such machines may be seen, for example: in U.S. Pat. No. 2,410,679 of J. H. Pikul for "Sewing Machine", issued Nov. 5, 1946; in U.S. Pat. No. 3,165,080 of L. Castelletti for "Hand Operated Button Sewer", issued Jan. 12, 1965; and my pending U.S. patent application for "Feeding Mechanism for Double Pointed Looper Sewing Machine", filed Jan. 28, 1983, and bearing Ser. No. 461,825.

It is a prime object of the invention to provide a feeding arrangement for a sewing machine of the described type enabling such machine to be readily converted to one on which work may be fed unidirectionally to provide for the formation of a straight line of stitches in the work piece.

It is another object of the invention to provide a top work feeding arrangement for a hand operable chain stitch sewing machine.

Other objects and advantages of the invention will become apparent during a reading of the specification taken in connection with the accompanying drawings.

SUMMARY OF THE INVENTION

A chain stitch sewing machine according to the invention includes mechanism responsive to the operation of a handle for moving a needle and looper point into cooperative association for the formation of stitches. Such mechanism includes spring means which biases the handle to a defined hands off position. The sewing machine further includes a feed dog with a work engageable end portion and a rearward extension, a work supporting bed, a pressure plate which holds the work piece against the bed and includes one or more openings for the feed dog to extend through and engage the work piece, means mounting the feed dog along the rearward extension for pivotal movement in the machine about mutually perpendicular axes, and means responsive to the operation of the handle for pivoting the feed dog about one of said axes to thereby move the feed dog from an initial position with the end portion above the work piece to a position wherein the work piece is engaged by said end portion, and for moving the feed dog about the other axis while engaged with the work piece to thereby move the work piece relative to the needle, the feed dog being operably associated with said spring means for return thereby through movement about said axes to the said initial position.

DESCRIPTION OF THE PREFERRED EMBODIMENT

Figure 1:
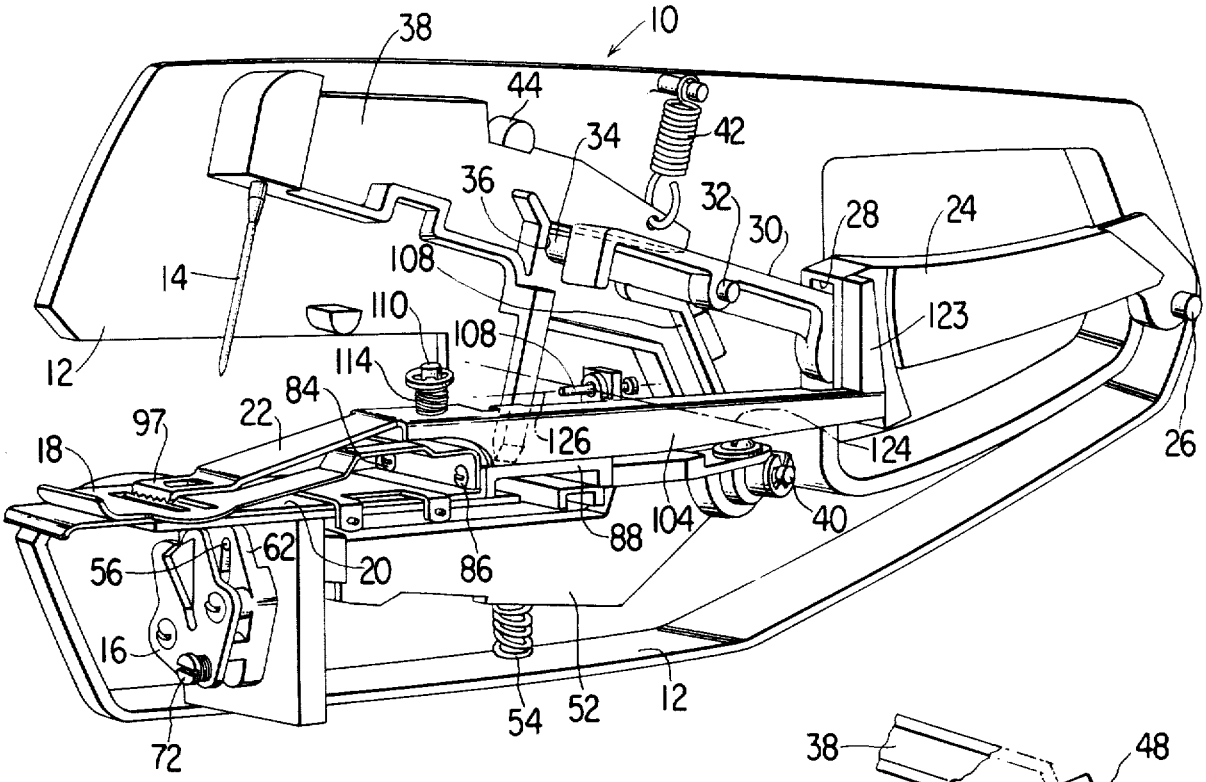
FIG. 1 is a perspective side view of a machine according to the invention having one side of the frame removed to show internal parts.
Figure 2:
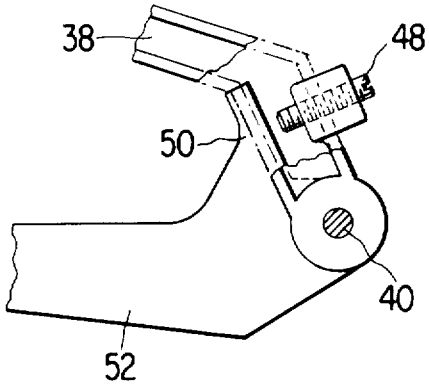
FIG. 2 is a fragmentary side view showing a portion of the machine of FIG. 1.
Figure 3:
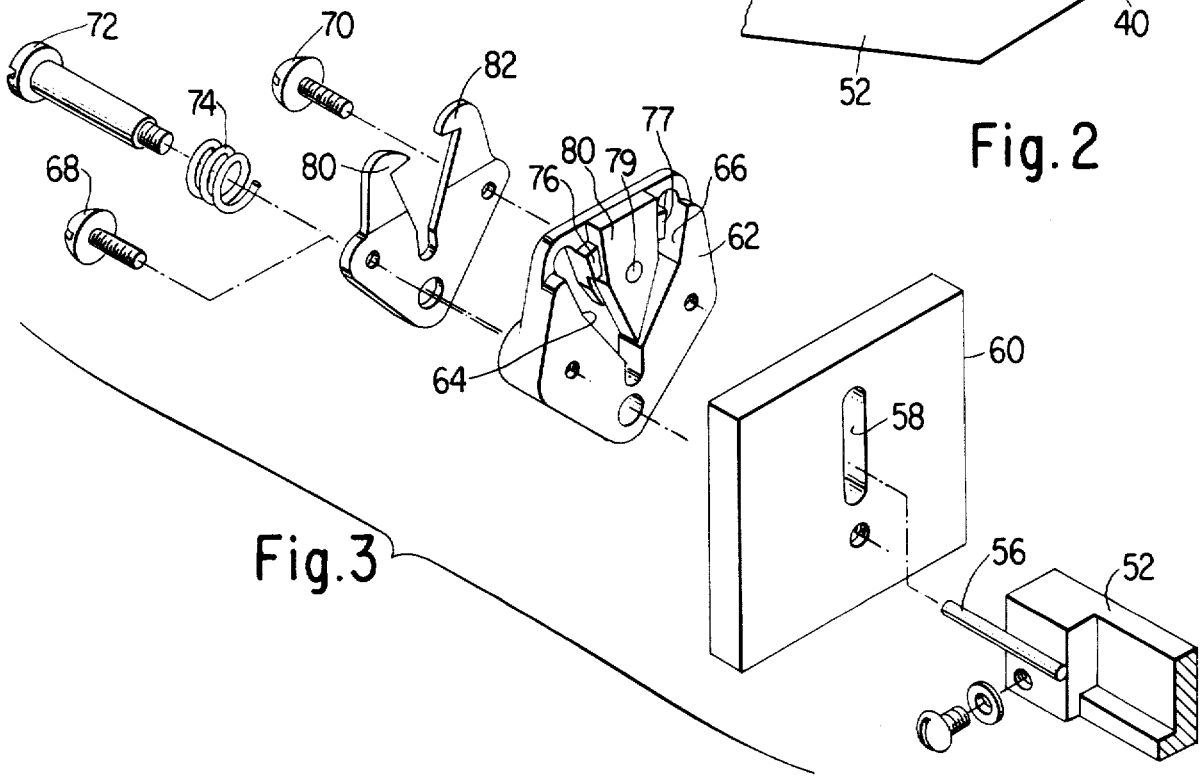
FIG. 3 is a fragmentary exploded perspective view showing the looper actuating mechanism of the machine.
Figure 4:
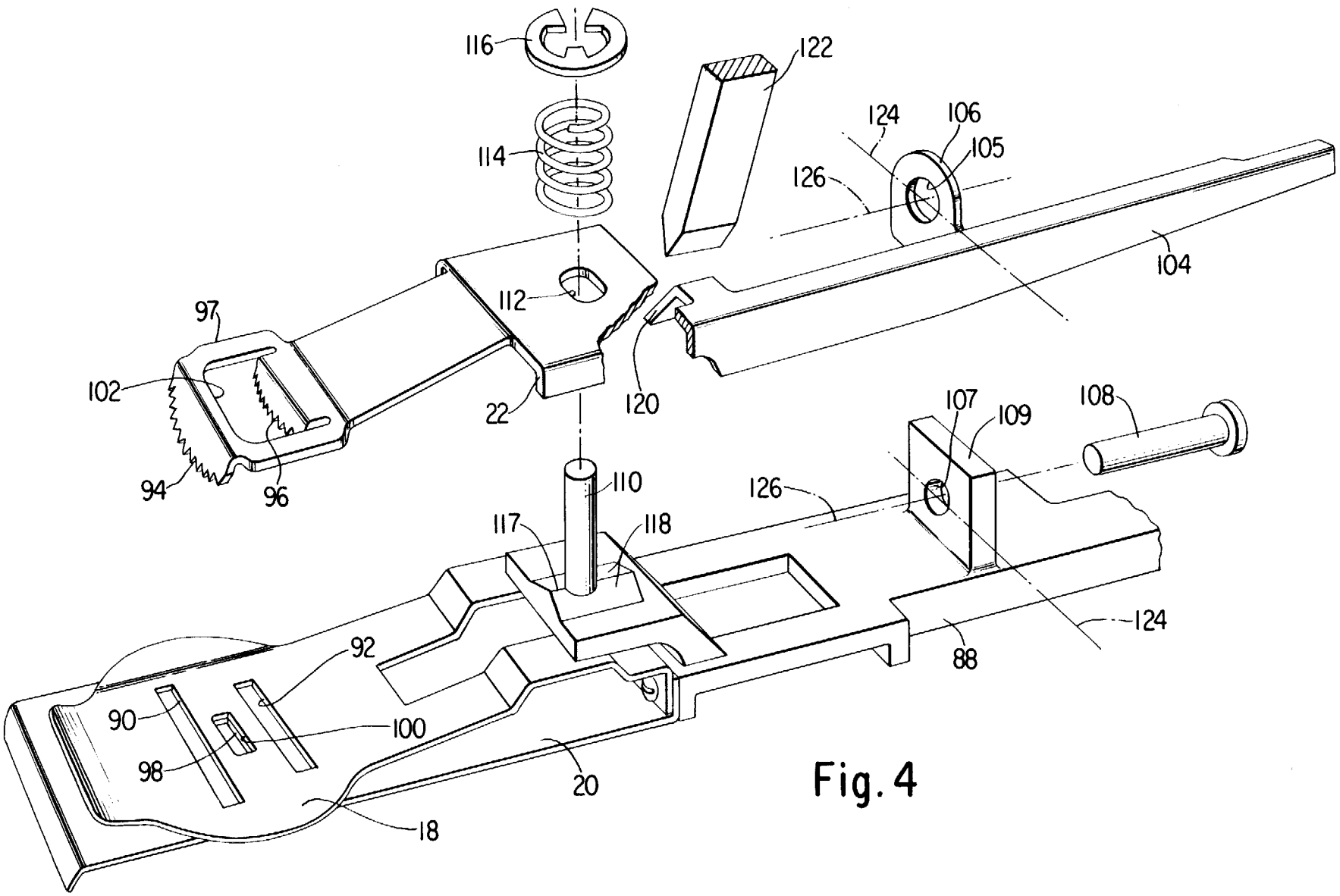
FIG. 4 is a fragmentary exploded perspective view showing the work feeding arrangement of the machine.

Referring to the drawings, there is shown a hand held sewing machine 10 according to the invention, including a frame 12, a thread carrying needle 14 arranged for reciprocating movement, and a pivotally movable looper 16 which cooperates with the needle in the formation of chain stitches. A pressure plate 18 serves to hold material against a rigid bed plate 20, and a topside feed dog 22 is provided to move the material under the needle during a sewing operation. A handle 24 having one end pivotally attached at 26 to the frame 12 is operably connected to the needle 14, looper 16 and feed dog 22 for imparting the desired movements thereto.

Handle 24 connects in a slot 28 with one end of a lever 30 which is pivotally mounted on a pin 32 affixed in frame 12. The opposite end of lever 30 includes a laterally projecting pin 34 which extends into a slot 36 in an arm 38 that carries needle 14 at one end and is pivotally mounted at the other end on a shaft 40 affixed in frame 12. Arm 38 is biased upwardly by spring 42 into engagement with a stop 44. The arm is caused to move downwardly and dispose needle 14 for cooperation with the looper 16 whenever handle 24 is squeezed upwardly. When handle 24 is released, the arm is returned to a position of engagement with stop 44 by spring 42.

Arm 38 carries an adjustable screw 48 which is caused during a latter portion of the descent of arm 38 to engage an upward extension 50 on a looper drive arm 52, and move the drive arm downwardly about one end pivoted on shaft 40 against the bias of a return spring 54. A drive pin 56 projects outwardly from the free end extremity of arm 52 and extends through a vertical pin guiding slot 58 in a guide block 60 which is rigidly attached to frame 12. Pin 56 extends beyond block 60 to engage a cam 62 along a cam track 64. Looper 16 is affixed to cam 62 with screws 68 and 70, and the assembly is mounted on block 60 with a shouldered screw 72 and spring 74 for pivotal movement on the screw 72. Cam 62 includes a fixed pin 79 which supports a gate 80 in a stationary position between confining abutments 76 and 77 on the cam. The gate permanently blocks access by pin 56 to a track 66 in cam 62, but permits the pin to slidingly engage track 64 and thereby effect pivotal movement as required to place a loop seizing point 80 on the looper into cooperative association with the needle 14 to provide for the formation of chain stitches in a manner well understood in the art. Although track 66 isn't utilized in the machine of the present invention, it is shown to illustrate the possible use of a cam 62 of the kind disclosed in my aforementioned copending U.S. patent application with Ser. No. 461,825 now U.S. Pat. No. 4,463,695. Since pin 56 never enters track 66, a second looper point 82 shown on looper 16 isn't disposed into cooperative association with needle 14, and therefor doesn't enter into the stitch forming process. The second looper point 82 is shown to illustrate the possible use of a looper 16 of the kind disclosed in the said patent application.

Bed plate 20 and presser plate 18 are affixed with screws 84 and 86 to one end of a member 88 which is suitably secured against movement to the frame of the machine. The presser plate is of a resilient material and is biased against the bed plate. Slots 90 and 92 are provided in the presser plate 18 to permit teeth 94 and 96 on a forward end portion 97 of the feed dog 22 to extend through the presser plate and engage material disposed betWeen the presser plate 18 and bed plate 20. Slots 98, 100 and 102 in the bed plate, presser plate and end portion 97 of the feed dog respectively, permit the needle 14 to be moved through these members and cooperate with looper seizing point 80 on looper 16 in the formation of chain stitches.

The feed dog 22 includes a rearward extension 104 with a flange 106 thereon where the feed dog is loosely pivoted on a pin 108 extending through an opening 105 in the flange 106, and through an opening 107 in a flange 109 on frame affixed member 88. An upstanding fixed pin 110 on member 88 in a common longitudinally extending plane with pin 108 extends loosely through an elongated hole 112 in the feed dog, and a spring 114 between the feed dog and an E clamp 116 on the pin biases the feed dog toward the apex 117 of a triangularly configured cam 118 on member 88. Apex 117 is in longitudinal alignment with the axis of pin 108. The feed dog extension 104 includes an angularly depending cam 120 which is engageable with a plunger 122 that is an integral part of arm 38.

Handle 24 is biased by the action of spring 42 to a hands off position in which feed dog extension 104 is engaged by a handle appendage 123, and caused to assume a position against member 88 defining an initial position for the feed dog in which the feed dog is disengaged from cam 118, spring 114 is compressed, and the feed dog teeth are above the presser plate and any work piece thereunder.

When handle 24 is squeezed upwardly, appendage 123 is released from engagement with feed dog extension 104, and the feed dog 22 is pivoted by spring 114 on the loose pivotal mount at pin 108 about a transverse axis 124 substantially perpendicular to the axis 126 of pin 108 to thereby bring the feed dog into engagement with the apex 117 of cam 118, and teeth 94 and 96 into engagement with a work piece under the presser plate 18. Further upward squeezing of the handle 24 results in the engagement of plunger 122 with cam 120 and the feed dog being pivoted by the plunger about axis 126 and on apex 117 of cam 118 to cause the feed dog teeth 94 and 96 to move the work piece under needle 14. The feed dog teeth extend along arcuate peripheries, as shown and thereby assure the continued engagement of teeth with the work piece during said pivotal movement of the feed dog about axis 126. As noted hereinbefore, during the upward squeezing of handle 24, needle 14 is moved downwardly by the handle acting through lever 30 and arm 38, and the looper 16 is moved by the arm 38 acting through drive arm 52 to dispose the looper for cooperation with the needle in the formation of chain stitches. The needle penetrates the work piece to provide for the formation of a stitch only after the work piece has been moved by the feed dog and while the feed dog is being held stationary by engagement of the plunger 122 with cam 120.

When the handle 24 is released, the looper 16 and needle 14 are returned to initial positions by the action of springs 54 and 42, respectively. Appendage 123 on handle 24 engages the feed dog extension 104 as the plunger 122 disengages cam 120, and the feed dog is caused by the appendage to pivot on the loose pivotal mount at pin 108 about both of the axes 124 and 126. The feed dog teeth are therefor lifted from the work piece and the feed dog is returned to its initial position. The handle comes to rest in the hands off position defined by the engagement of appendage 123 with feed dog extension 104, and of the extension 104 with member 88. The described operative cycle is repeated as many times as may be required to perform the sewing task at hand.

It is to be understood that the present disclosure relates to a preferred embodiment of the invention which is for purposes of illustration only and is not to be construed as limiting the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. In a sewing machine; a sewing needle; a looper with a loop seizing point; a movable handle; mechanism responsive to the operation of the handle for moving the needle and looper into cooperative association for the formation of chain stitches, said mechanism including spring means which biases the handle to a defined hands off position; a feed dog with a work engageable end portion and a rearward extension; a work supporting bed; a pressure plate for holding a work piece against the bed, said plate including one or more openings for the feed dog end portion to extend through and engage the work piece; means mounting the feed dog along the rearward extension for pivotal movement in the machine about mutually perpendicular axes; and means responsive to the operation of the handle for pivoting the feed dog about one of said axes to thereby move said feed dog from an initial position with the end portion above the work piece to a position wherein the work piece is engaged by said end portion, and for moving the feed dog about the other axis while engaged with the work piece to thereby move the work piece relative to the needle; the feed dog being operably associated with said spring means for return thereby through movement about both of said axes to the said initial position.

2. The combination of claim 1 wherein the means responsive to the operation of the handle includes a spring for pivoting the feed dog about said one axis.

3. The combination of claim 2 wherein the spring for pivoting the feed dog about said one axis is located between the work piece engaging end portion of the feed dog and the means mounting the feed dog for pivotal movement.

4. The combination of claim 1 including a plunger operably associated with said mechanism and engageable with the feed dog for pivoting the feed dog about said other axis.

5. The combination of claim 1 wherein the feed dog has a cam formed thereon, and a plunger is provided in operative association with said mechanism to engage the cam and pivot the feed dog about said other axis.

6. The combination of claim 1 wherein the handle has a member affixed thereon to engage the rear extension of the feed dog and dispose the feed dog in said initial position when the handle is in its hands off position.

* * * * *